US010673153B1

(12) United States Patent
Pan

(10) Patent No.: US 10,673,153 B1
(45) Date of Patent: Jun. 2, 2020

(54) TAIL COVER-PULLING TYPE CONNECTOR

(71) Applicant: FOSHAN OJUN ELECTRONIC CO., LTD., Foshan (CN)

(72) Inventor: Changxiong Pan, Foshan (CN)

( * ) Notice: Subject to any disclaimer, the term of this patent is extended or adjusted under 35 U.S.C. 154(b) by 0 days.

(21) Appl. No.: 16/510,841

(22) Filed: Jul. 12, 2019

(30) Foreign Application Priority Data

Feb. 23, 2019 (CN) ..... 2019 2 0233489 U

(51) Int. Cl.
*H01R 13/62* (2006.01)
*H01R 9/24* (2006.01)
*H01R 9/22* (2006.01)
*H01R 4/48* (2006.01)

(52) U.S. Cl.
CPC ..... *H01R 9/2416* (2013.01); *H01R 4/48* (2013.01); *H01R 9/223* (2013.01)

(58) Field of Classification Search
CPC ..... H01R 13/193; H01R 13/20; H01R 13/639
USPC ..... 439/296, 346, 347, 680, 681
See application file for complete search history.

(56) References Cited

U.S. PATENT DOCUMENTS 4,004,845 A * 1/1977 Sochor ..... H01R 12/7082 439/682
5,672,073 A * 9/1997 Matsumura ..... H01R 13/641 439/188
6,283,801 B1 * 9/2001 Guinda ..... H01R 4/4845 439/787
6,736,683 B2 * 5/2004 Brand ..... H01R 4/4827 439/828
7,131,857 B2 * 11/2006 Mueller ..... H01R 4/4845 439/441
9,577,362 B1 2/2017 Snyder et al.
9,673,541 B2 * 6/2017 Zhong ..... H01R 4/4827
9,812,822 B2 * 11/2017 Scanzillo ..... H01R 4/4818
10,270,189 B2 * 4/2019 Scanzillo ..... H01R 4/4818
10,587,057 B2 * 3/2020 Ishikawa ..... H01R 13/428
2003/0232525 A1 12/2003 Ward
2008/0020609 A1 1/2008 Robinette

FOREIGN PATENT DOCUMENTS

CN 201117847 Y 9/2008
CN 201289927 Y 8/2009
CN 205141191 U 4/2016

* cited by examiner

*Primary Examiner* — Phuong Chi Thi Nguyen
(74) *Attorney, Agent, or Firm* — Erson IP (Nelson IP)

(57) ABSTRACT

The utility model provides a tail cover-pulling type connector, comprising a first shell, a second shell, a handle, an elastic piece and a conductor, wherein, the first shell is detachably connected with the second shell, the first shell and the second shell form a receiving space, the second shell is provided with a first through hole communicated with the receiving space and used for inserting a wire, the handle is rotatably arranged in the first shell, the conductor and the elastic piece are arranged in the receiving space and the conductor is located over the elastic piece, and a holding space for holding the wire is formed between the conductor and the elastic piece. The tail cover-pulling type connector is reliable in structure and convenient to disassemble, and the connection of the wire is firm.

7 Claims, 7 Drawing Sheets

TAIL COVER-PULLING TYPE CONNECTOR

CROSS-REFERENCE TO RELATED APPLICATIONS

This application claims priority to Chinese Patent Application No. 201920233489.5 with a filing date of Feb. 23, 2019. The content of the aforementioned applications, including any intervening amendments thereto, are incorporated herein by reference.

TECHNICAL FIELD

The utility model relates to the technical field of connectors, and particularly relates to a tail cover-pulling type connector.

BACKGROUND OF THE PRESENT UTILITY MODEL

A connector, as a connection assembly for an electron element, an electric appliance and the like, can take effects of wiring and electrification so as to achieve good connection function of wiring and electrification, is an important wiring component for electric appliance connection and connection between a terminal and another terminal.

In related techniques, the connector typically adopts the following two manners when in wiring:

Mode 1: peeling a wire sheath, riveting a terminal and inserting a wire for connection. Defects: wiring steps are complicated and inconvenient for local operation, the wire is difficult to disassemble, and wire connection is unstable.

Mode 2: peeling a wire sheath, soldering, and inserting a wire for connection. Defects: wiring steps are complicated and inconvenient for local operation, and wire connection is unstable.

SUMMARY OF PRESENT UTILITY MODEL

The object of the utility model is to provide a tail cover-pulling type connector to solve the above technical problems.

Embodiments of the utility model are realized as follows: provided is a tail cover-pulling type connector, comprising a first shell, a second shell, a handle, an elastic piece and a conductor, wherein, the first shell is detachably connected with the second shell, the first shell and the second shell form a receiving space, the second shell is provided with a first through hole communicated with the receiving space and used for inserting a wire, the handle is rotatably arranged in the first shell, the conductor and the elastic piece are arranged in the receiving space and the conductor is located over the elastic piece, and a holding space for holding the wire is formed between the conductor and the elastic piece;

the tail cover-pulling type connector has a locking position and an unlocking position, when the tail cover-pulling type connector is in the unlocking position, the handle rotates in a first direction so that the elastic piece is far away from the conductor, and when the tail cover-pulling type connector is in the locking position, the handle rotates in a second direction so that the elastic piece is close to the conductor.

Optionally, the first shell is internally provided with a cambered surface for matching with at least one part of the handle, when the tail cover-pulling type connector is in the unlocking position, the handle is far away from the cambered surface to form a vacancy between the handle and the cambered surface.

Optionally, the first shell is provided with clamp portions which are distributed at the upper side and the lower side of the first shell, the second shell is provided with clamp holes which are distributed at the upper side and the lower side of the second shell, and the clamping portions are used for clamping with the clamping holes.

Optionally, the tail cover-pulling type connector also comprises a platy connection portion, the clamping portion at the upper side of the first shell is arranged on the connection portion, and the second shell is provided with a slot to be connected with the connection portion in an insertion manner.

Optionally, the clamping hole is configured as a through hole.

Optionally, the clamping portion is configured as a trapezoid shape.

Optionally, the elastic piece is of a V shape, the elastic piece comprises a plane-shaped installation portion to be matched with the internal surface of the first shell and/or the second shell.

The embodiments of the utility model have the beneficial effects that the wire can be inserted into the first through hole of the second shell, the elastic piece is far away from or close to the conductor through rotation of the handle so that the receiving space between the elastic piece and the conductor is changed, in such a way, the wire can be held or loosened. The wire can be grasped by a single hand and the handle is simultaneously rotated without changing the hand, thereby shortening the installation time of the wire. In such a way, the wire can be greatly convenient to assemble and disassemble, and meanwhile, the wire can be stably held in the holding space. Since the conductor is located in the receiving space, the conductor is avoided to be exposed, which is more advantageous for safety of a user, the crimping force point of the tail cover-pulling type connector is located in the middle of the connector so that when the handle is rotated, the wire is more easily crimped between the elastic piece and the conductor.

DESCRIPTION OF THE DRAWINGS

In order to better describe the technical solution of the embodiments of the utility model, drawings used in the embodiments will be simply described below. It should be understood that the following drawings are only for illustrating some embodiments of the utility model, and therefore should not be considered as limiting the scope. For those of ordinary skill in the art, other correlated drawings can also be obtained according to these drawings without any creative efforts.

REFERENCE NUMBERS

Figure 1:
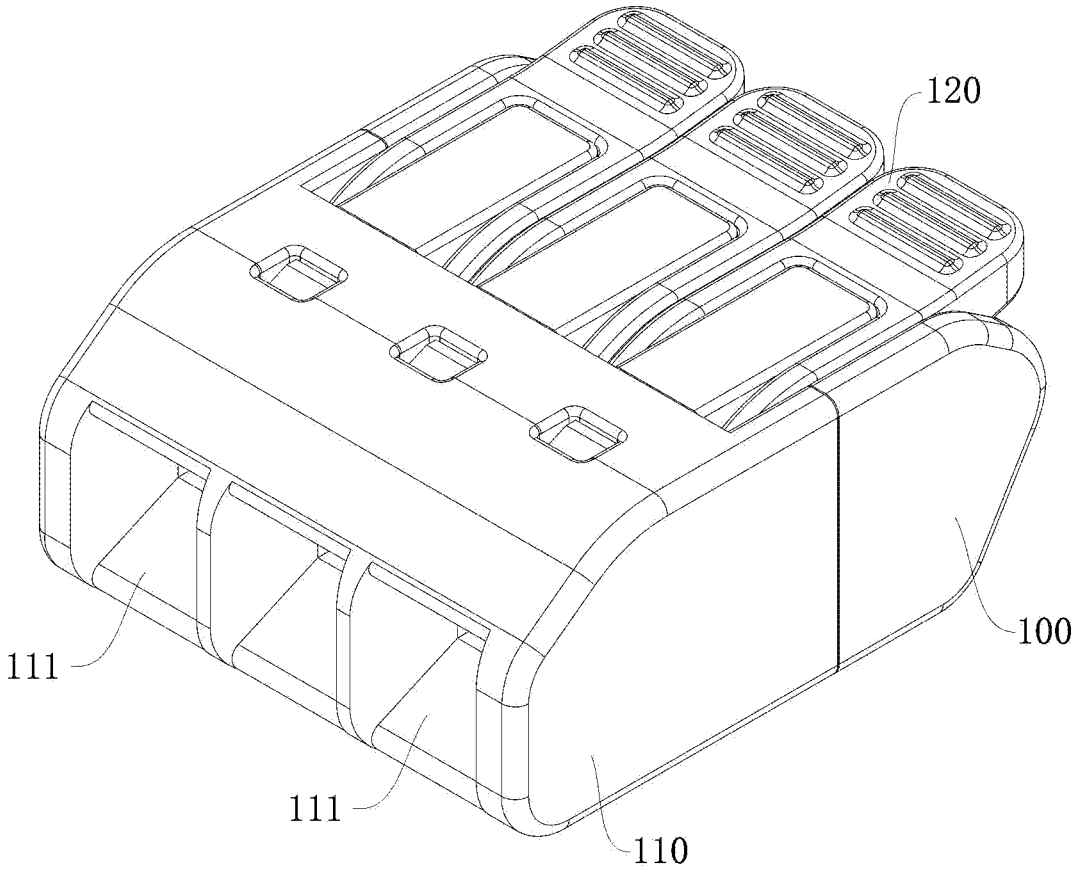
FIG. 1 is a structural diagram of a tail cover-pulling type connector according to an embodiment of the utility model.
Figure 2:
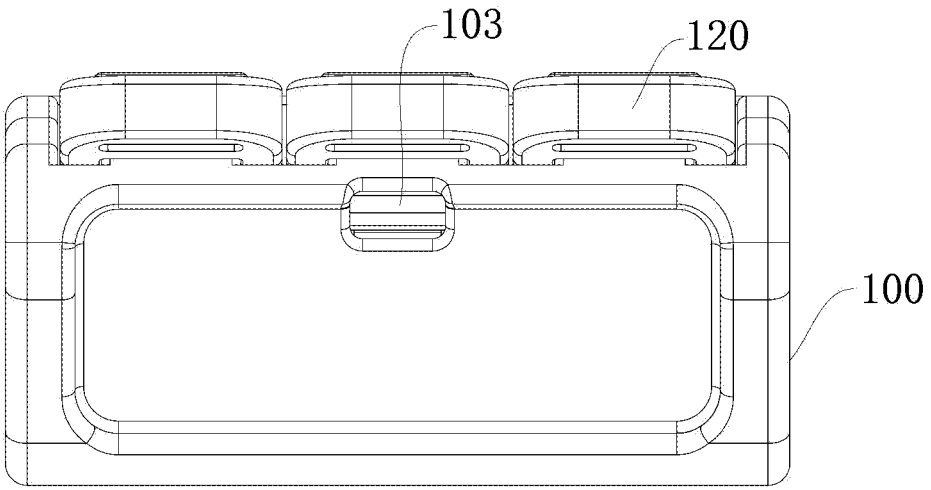
FIG. 2 is a structural diagram of FIG. 1 from a first perspective view.
Figure 3:
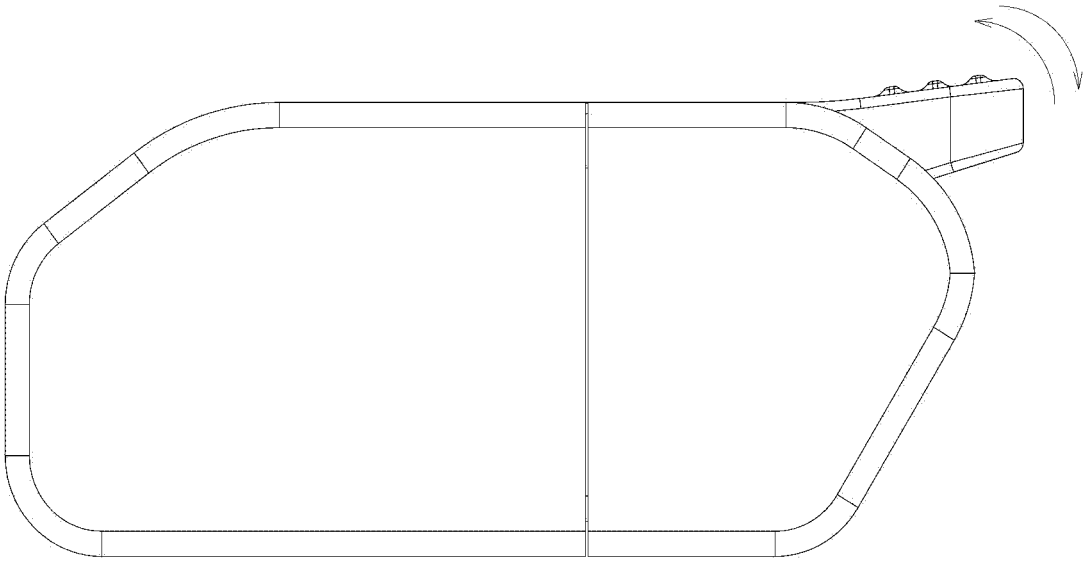
FIG. 3 is a structural diagram of FIG. 1 from a second perspective view.

100-first shell; 101-connection portion; 102-clamping portion; 103-second through hole; 104-cambered surface; 110-second shell; 111-first through hole; 112-clamping hole; 113-slot; 120-handle; 121-first resisting portion; 130-elastic piece; 131-second resisting portion; 132-installation portion; 140-condcutor

DETAILED DESCRIPTION OF PREFERRED EMBODIMENTS

In order to make the purpose, technical solution and advantages of the embodiments of the utility model more clear, the technical solutions in the embodiments of the utility model will be clearly and completely described in combination with drawings in the embodiments of the utility model, apparently, the described embodiments are one part of embodiments in the utility model but not all the embodiments. Typically, components of the embodiment of the utility model described and illustrated in drawings herein can be arranged and designed in different configurations.

Thus, the detailed descriptions of the embodiments of the utility model provided in the drawings are not intended to limit the protection scope of the utility model, and only represent the selected embodiments of the utility model. Based on embodiments of the utility model, other embodiments obtained by those of ordinary skill in the art without any creative efforts are all included in the protection scope of the utility model.

Referring to FIG. 1-FIG. 5, an embodiment of the utility model provides a tail cover-pulling type connector, comprising a first shell 100, a second shell 110, a handle 120, an elastic piece 130 and a conductor 140, wherein, the first shell 100 is detachably connected with the second shell 110, the first shell 100 and the second shell 110 form a receiving space, the second shell 110 is provided with a first through hole 111 communicated with the receiving space and used for inserting a wire, the handle 120 is rotatably arranged in the first shell 100, the conductor 140 and the elastic piece 130 are arranged in the receiving space and the conductor 140 is located over the elastic piece 130, and a holding space for holding the wire is formed between the conductor 140 and the elastic piece 130; the tail cover-pulling type connector has a locking position and an unlocking position, when the tail cover-pulling type connector is in the unlocking position, the handle 120 rotates in a first direction so that the elastic piece 130 is far away from the conductor 140, when the tail cover-pulling type connector is in the locking position, the handle 120 rotates in a second direction so that the elastic piece 130 is close to the conductor 140.

Where, the first direction is one of an anti-clockwise direction or a clockwise direction, the second direction is the other one of the anti-clockwise direction or the clockwise direction, that is to say, the first direction and the second direction both rotate around the same point, and the first direction is opposite to the second direction.

Through the above technical solution, a wire can be inserted into the first through hole 111 of the second shell 110, the elastic piece 130 is far away from or close to the conductor 140 through rotation of the handle 120, so that the receiving space between the elastic piece 130 and the conductor 140 is changed. In such a way, the wire can be held or loosened, the wire can be grasped by the single hand and the handle 120 is simultaneously rotated without changing the hand, thereby shortening the installation time of the wire. In such a way, the wire can be greatly convenient to assemble and disassemble, and meanwhile, the wire can be stably held in the holding space. Since the conductor 140 is located in the receiving space, the conductor 140 is avoided to be exposed, which is more advantageous for safety of a user, the crimping force point of the tail cover-pulling type connector is located in the middle of the connector so that when the handle 120 is rotated, the wire is more easily crimped between the elastic piece 130 and the conductor 140; in addition, since the crimping force point is located in the middle of the tail cover-pulling type connector, so that when the handle 120 rotates, the downward press space of the elastic piece 130 is larger, which is more convenient for assembling and disassembling of the wire.

Figure 5:
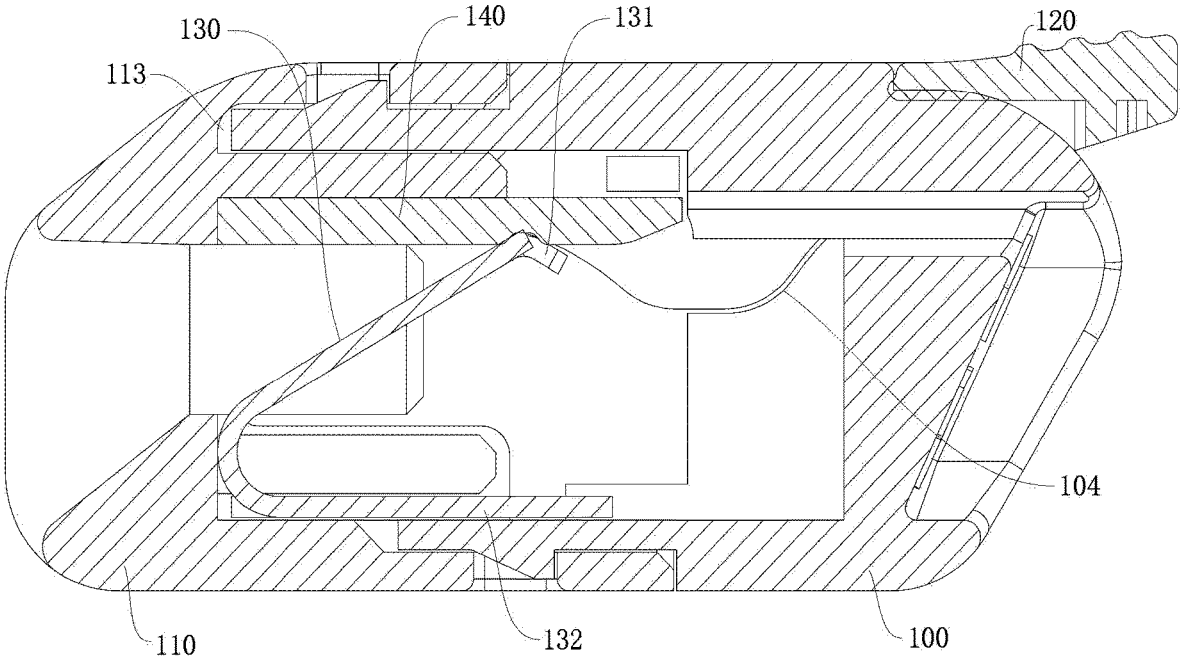
FIG. 5 is a cross-sectional view taken along A-A in FIG. 4.
Figure 9:
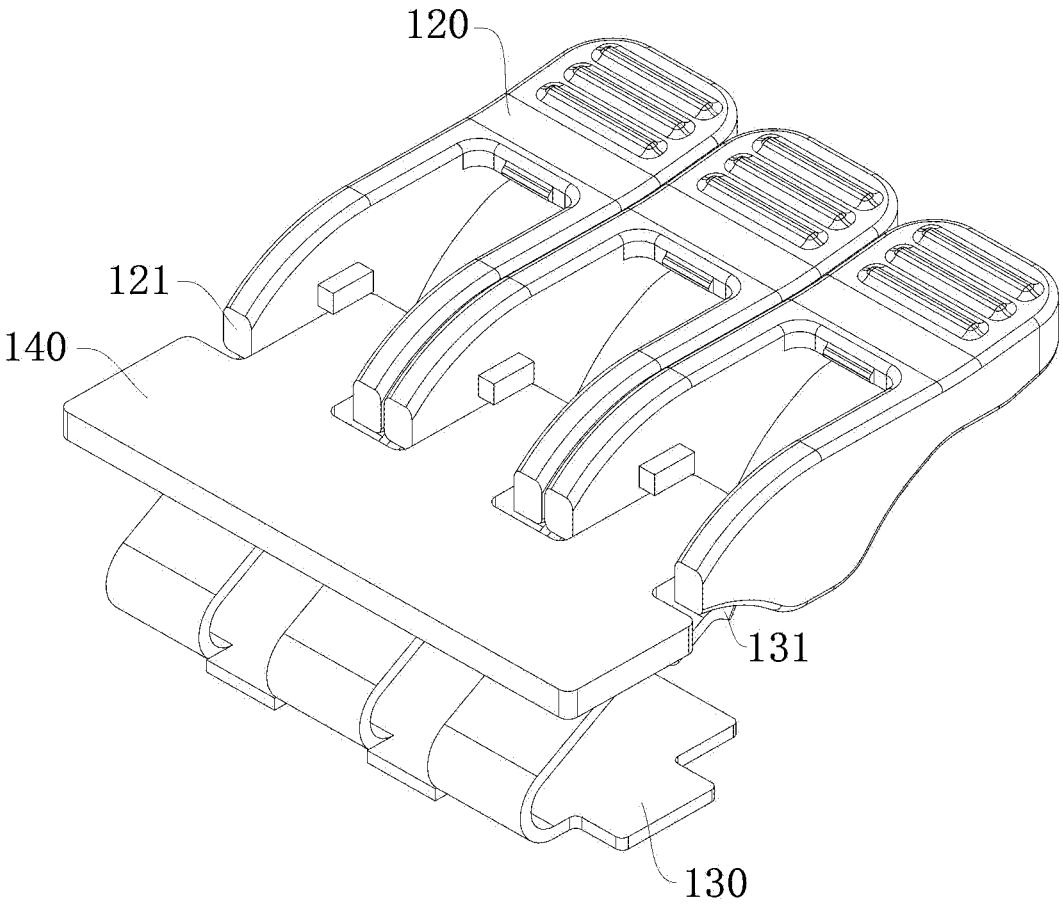
FIG. 9 is a structural diagram of a handle, a conductor and an elastic piece according to an embodiment of the utility model.
Figure 10:
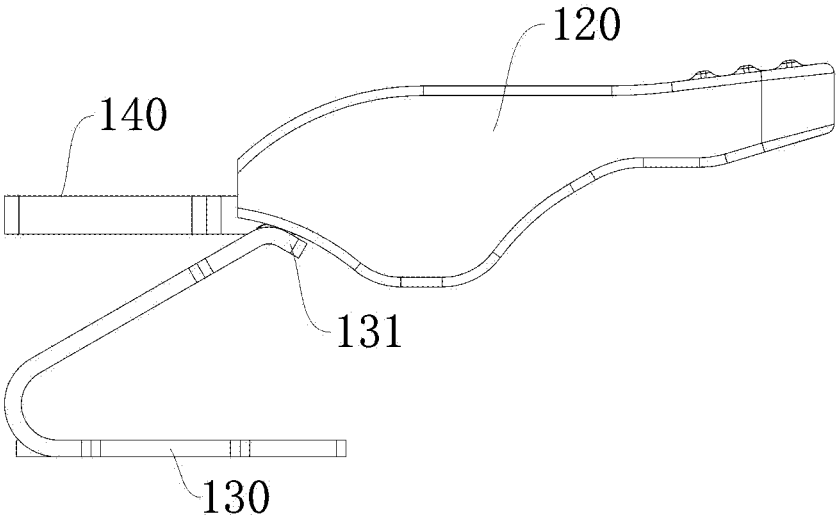
FIG. 10 is a structural diagram of FIG. 9 from another perspective view.

Referring to FIG. 5, FIG. 9 and FIG. 10, particularly, the handle 120 comprises a first resisting portion 121 which is formed by one end of the handle 120 and located in the receiving space, the elastic piece 130 comprises a second resisting portion 131 which is formed by one end of the elastic piece 130, the second resisting portion 131 is bent so that the first resisting portion 121 downwardly presses the second resisting portion 131.

Referring to FIG. 5, FIG. 9 and FIG. 10, in this embodiment, the elastic piece 130 is of a V shape, the conductor 140 and the elastic piece 130 are entirely configured as an Z shape, and the V-shaped elastic piece 130 can provide a larger elastic recovery force so as to firmly hold the wire. Furthermore, the elastic piece 130 comprises a planar installation portion 132 which is matched with the internal surface of the first shell 100 and/or the second shell 110. In other words, the internal bottom surface of the first shell 100 and/or the second shell 110 is also of a plane shape. Through surface-to-surface fitting, when the handle 120 applies a pressure to the elastic piece 130, it is ensured that the position of the elastic piece 130 is relatively stable.

Figure 4:
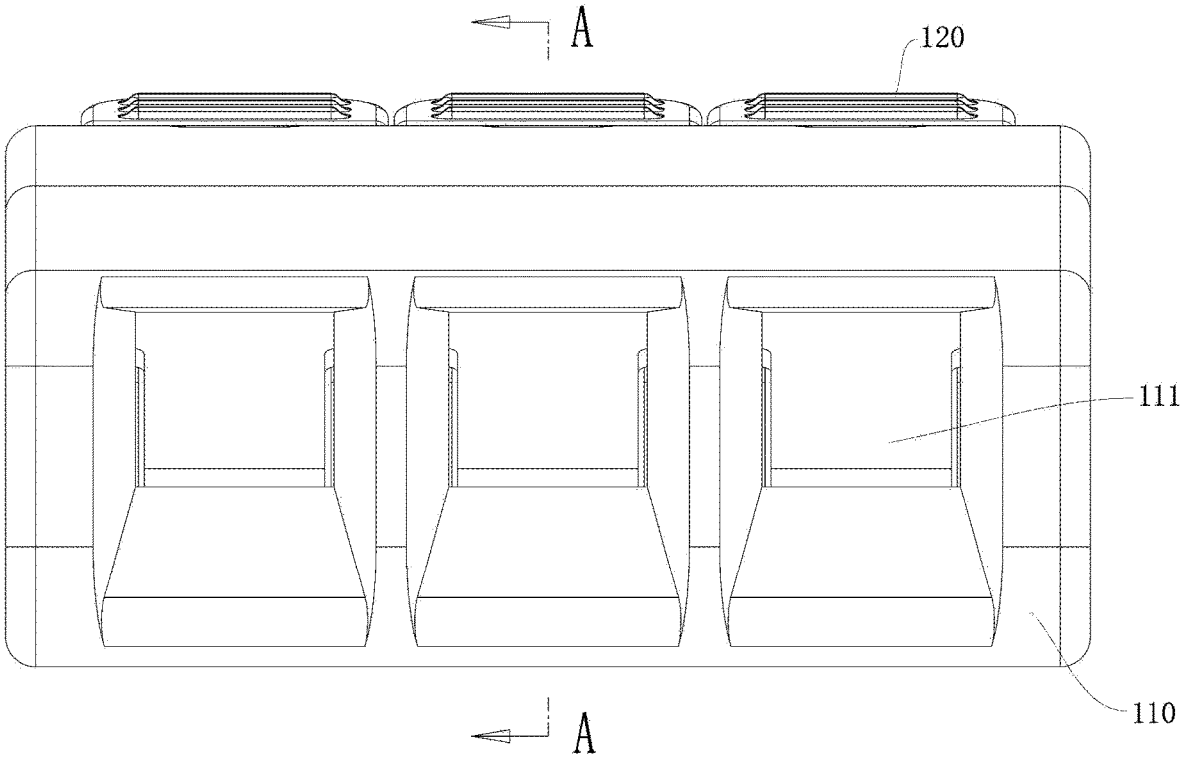
FIG. 4 is a structural diagram of FIG. 1 from a third perspective view.

Referring to FIG. 4 and FIG. 5, the first shell 100 is internally provided with a cambered surface 104 for matching with at least one part of the handle 120, when the tail cover-pulling type connector is in the unlocking position, the handle 120 is far away from the cambered surface 104 to form a vacancy between the handle 120 and the cambered surface 104. Correspondingly, when the tail cover-pulling type connector is in the locking position, the handle 120 is close to the cambered surface 104 which is configured as the sunken bottom of the tail cover-pulling type connector, in such a way, the rotation of the handle 120 is facilitated.

Figure 6:
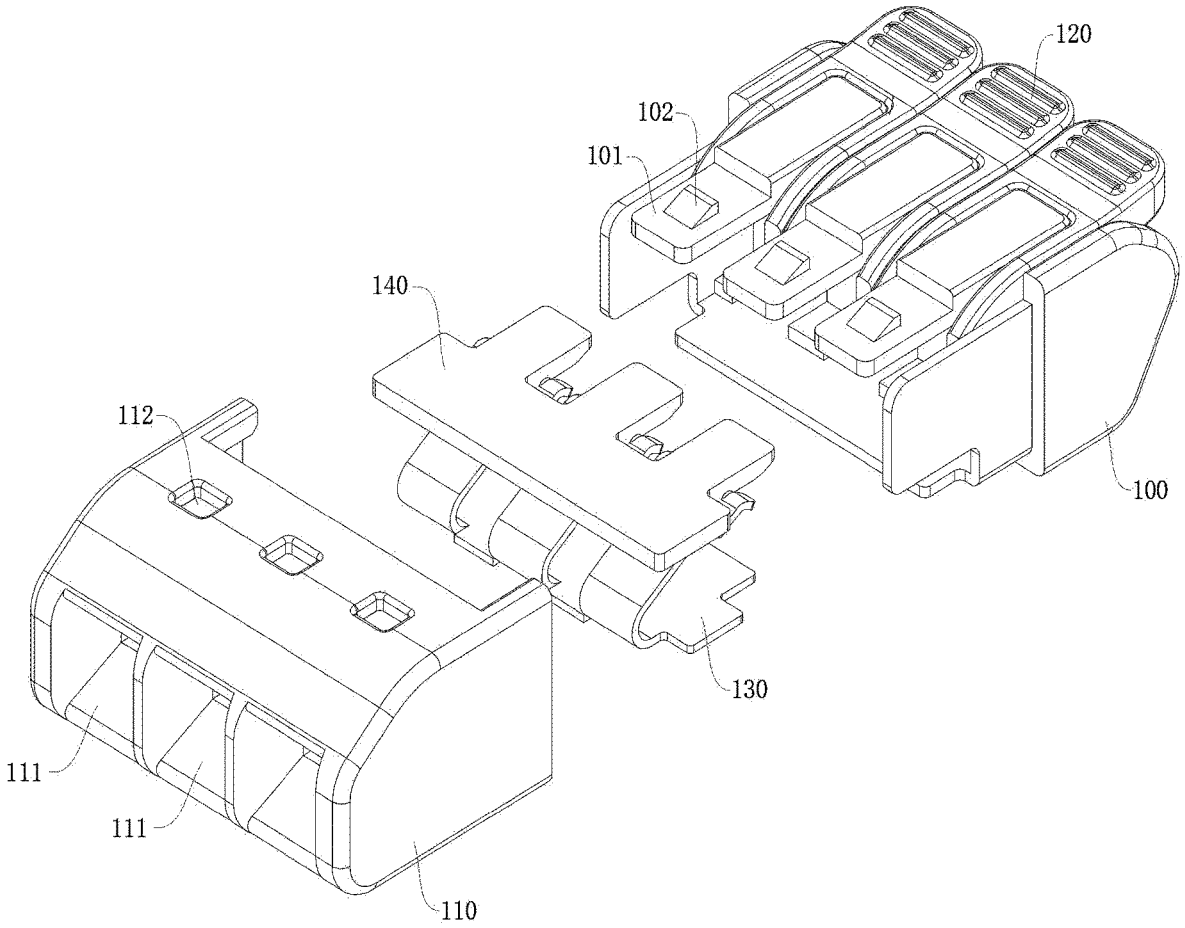
FIG. 6 is an exploded diagram of a tail cover-pulling type connector according to an embodiment of the utility model.
Figure 8:
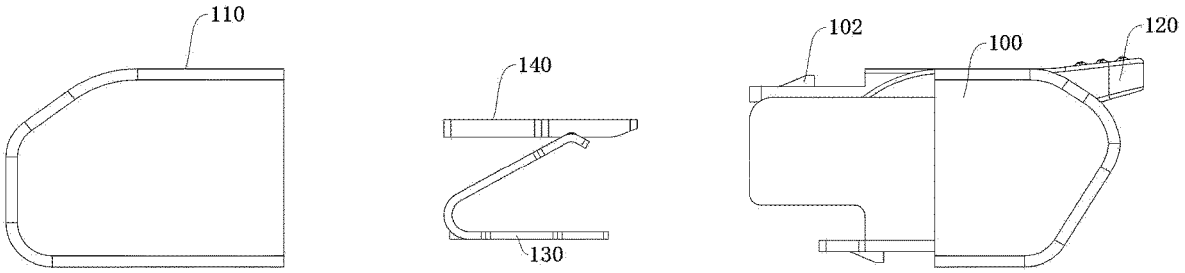
FIG. 8 is a structural diagram of FIG. 6 from a second perspective view.

Referring to FIG. 5, FIG. 6 and FIG. 8, in this embodiment, the first shell is provided with clamp portions 102 which are distributed at the upper side and the lower side of the first shell 100, the second shell 110 is provided with clamp holes 112 which are distributed at the upper side and the lower side of the second shell 110, and the clamping portions 102 are used for clamping with the clamping holes 112. Through clamping of the clamping portion 102 and the clamping hole 112, the tail cover-pulling type connector is convenient to assemble and disassemble. It is noted that a plurality of clamping portions, for example, three clamping portions, are located at the upper side of the second shell 110, correspondingly, three clamping holes 112 are located at the upper side of the second shell 110, and the above clamping holes 112 correspond to the clamping portion 102. In addition, the clamping hole 112 is configured as a through hole, when the tail cover-pulling type connector needs to be assembled and disassembled, it is convenient to push the clamping portion 102 to be withdrawn out of the clamping hole 112 through a tool. The shape of the clamping portion 102 is configured as a trapezoid shape, and one side of the clamping portion 102 close to the clamping hole 112 is an inclined surface so that the clamping portion 102 can smoothly enter the clamping hole 112.

Figure 7:
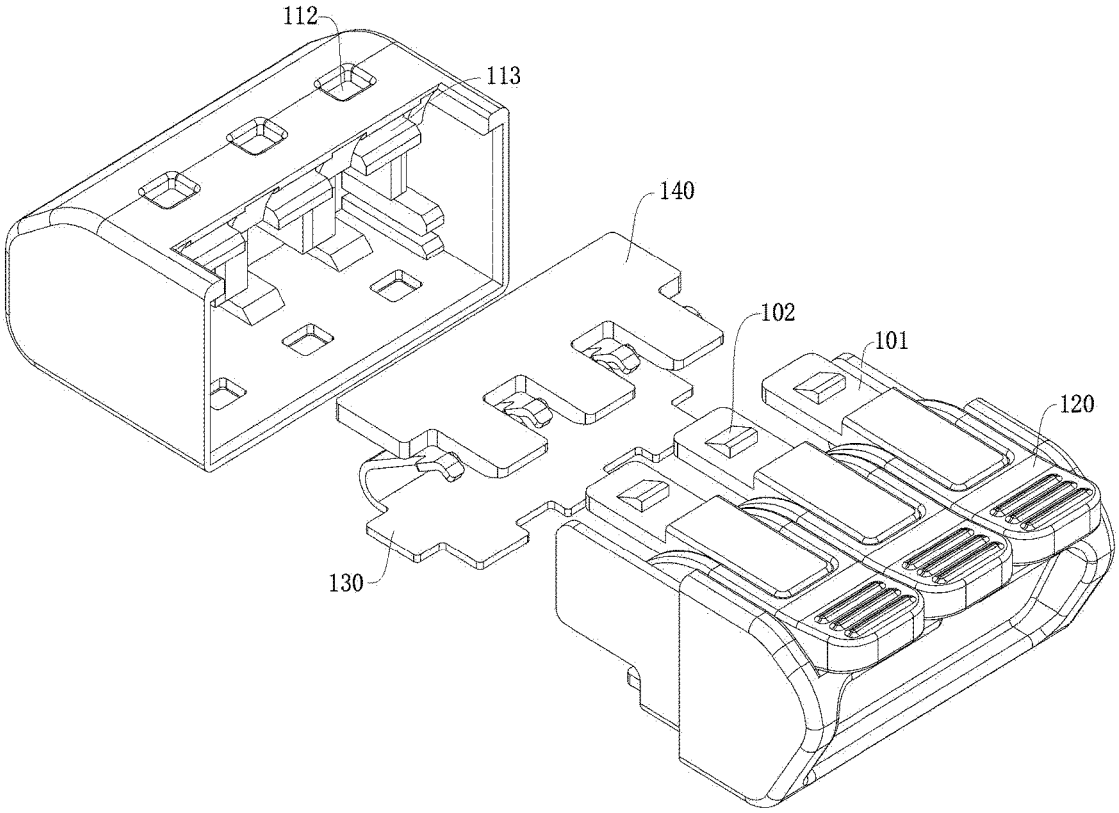
FIG. 7 is a structural diagram of FIG. 6 from a first perspective view.

Referring to FIG. 5, FIG. 6 and FIG. 7, in this embodiment, the tail cover-pulling type connector also comprises a platy connection portion 101, the clamping portion 102 at the upper side of the first shell 100 is arranged on the connection portion 101, the second shell 110 is provided with a slot 113 to be connected with the connection portion 101 in an insertion manner. The platy connection portion 101 is inserted into the slot 113 of the second shell 110, which can enhance the connection strength of the first shell 100 and the second shell 110 so that the structure of the tail cover-pulling type connector is better in stability.

In this embodiment, there are three first through holes, correspondingly, there are three handles 120.

The above descriptions are only a preferred embodiments of the utility model but do not limit the utility model. For those skilled in the art, the utility model has various modifications and changes. Any modifications, equivalent substitutions and improvements and the like made are all included within the protection scope of the utility model.

I claim:

1. A tail cover-pulling type connector, comprising a first shell, a second shell, a handle, an elastic piece and a conductor, wherein, the first shell is detachably connected with the second shell, the first shell and the second shell form a receiving space, the second shell is provided with a first through hole communicated with the receiving space and used for inserting a wire, the handle is rotatably arranged in the first shell, the conductor and the elastic piece are arranged in the receiving space and the conductor is located over the elastic piece, and a holding space for holding the wire is formed between the conductor and the elastic piece;

the tail cover-pulling type connector has a locking position and an unlocking position, when the tail cover-pulling type connector is in the unlocking position, the handle rotates in a first direction so that the elastic piece is far away from the conductor, when the tail cover-pulling type connector is in the locking position, the handle rotates in a second direction so that the elastic piece is close to the conductor.

2. The tail cover-pulling type connector according to claim 1, wherein, the first shell is internally provided with a cambered surface for matching with at least one part of the handle, when the tail cover-pulling type connector is in the unlocking position, the handle is far away from the cambered surface to form a vacancy between the handle and the cambered surface.

3. The tail cover-pulling type connector according to claim 1, wherein, the elastic piece is of a V shape, the elastic piece comprises a plane-shaped installation portion to be matched with the internal surface of the first shell and/or the second shell.

4. The tail cover-pulling type connector according to claim 1, wherein, the first shell is provided with clamp portions which are distributed at the upper side and the lower side of the first shell, the second shell is provided with clamp holes which are distributed at the upper side and the lower side of the second shell, and the clamping portions are used for clamping with the clamping holes.

5. The tail cover-pulling type connector according to claim 4, the tail cover-pulling type connector also comprising a platy connection portion, wherein, the clamping portion at the upper side of the first shell is arranged on the connection portion, and the second shell is provided with a slot to be connected with the connection portion in an insertion manner.

6. The tail cover-pulling type connector according to claim 4, wherein, the clamping hole is configured as a through hole.

7. The tail cover-pulling type connector according to claim 4, wherein, the clamping portion is configured as a trapezoid shape.

* * * * *